US007661983B2

(12) United States Patent
Yang et al.

(10) Patent No.: US 7,661,983 B2
(45) Date of Patent: Feb. 16, 2010

(54) LIGHTING CONNECTOR

(75) Inventors: Jui-Ming Yang, Keelung (TW); Chia-Chieh Chen, Taipei (TW); Yen-Tung Chen, Keelung (TW); Jui-Lin Yen, Doou-Liow (TW); Sz-Han Chen, Hsi-Chih (TW)

(73) Assignee: Elka International Ltd., Taipei Hsien (TW)

( * ) Notice: Subject to any disclaimer, the term of this patent is extended or adjusted under 35 U.S.C. 154(b) by 0 days.

(21) Appl. No.: 12/213,223

(22) Filed: Jun. 17, 2008

(65) Prior Publication Data

US 2009/0305521 A1 Dec. 10, 2009

(30) Foreign Application Priority Data

Jun. 4, 2008 (TW) ..... 97209862 U

(51) Int. Cl.
*H01R 3/00* (2006.01)

(52) U.S. Cl. ..... 439/490; 439/76.1

(58) Field of Classification Search ..... 439/76.1, 439/490

See application file for complete search history.

(56) References Cited

U.S. PATENT DOCUMENTS 6,165,006 A * 12/2000 Yeh et al. ..... 439/490
2008/0003867 A1* 1/2008 Wu ..... 439/490

* cited by examiner

*Primary Examiner*—Ross N Gushi
(74) *Attorney, Agent, or Firm*—Rosenberg, Klein & Lee

(57) ABSTRACT

A lighting connector including a terminal enclosure, an adapter circuit board and an insulating layer. Multiple terminals are enclosed in the terminal enclosure. A first side of the adapter circuit board is provided with multiple terminal contacts with which the terminals are respectively soldered. A second side of the adapter circuit board is provided with multiple wire contacts with which multiple signal wires are respectively soldered. The insulating layer encloses the terminal enclosure, the adapter circuit board and the signal wires. The insulating layer is made of a transparent material. At least one light-emitting element is arranged on the adapter circuit board. Two electrode pins of the light-emitting element are connected to a set of printed power circuits of the adapter circuit board. After turned on, the light-emitting element emits light which goes through the transparent insulating layer to outer side.

2 Claims, 3 Drawing Sheets

LIGHTING CONNECTOR

BACKGROUND OF THE INVENTION

1. Field of the Invention

The present invention is related to a lighting connector, and more particularly to a lighting connector including at least one light-emitting element soldered on an adapter circuit board connected between the terminals and the signal wires. The adapter circuit board serves to supply power to the light-emitting element to emit light in use of the lighting connector.

2. Description of the Prior Art

A conventional high definition multimedia interface (HDMI) connector includes a plastic enclosure and multiple terminals enclosed in the enclosure. Rear ends of the terminals are respectively soldered with multiple corresponding signal wires. The plastic enclosure and the terminals as well as the signal wires are enclosed in an insulating layer.

According to the above conventional connector, a user cannot judge whether the connector is in use or not in appearance. To solve this problem, some connectors are additionally equipped with light-emitting elements. Two electrode pins of the light-emitting element are soldered with a set of power wires and enclosed in a transparent insulating layer. In use, the light-emitting element is turned on to emit light.

In such connector, the electrode pins of the light-emitting element are directly soldered with the set of power wires. With an HDMI connector exemplified, there are 19 signal wires including two power wires for supplying power. In manufacturing, it is necessary to find out the power wires among the 19 signal wires and then solder the electrode pins of the light-emitting element with the power wires one by one. Such procedure is quite troublesome. In addition, before enclosed in the insulating layer by injection molding, the light-emitting element is not fixed. Therefore, in transfer, the light-emitting element is likely to detach due to collision or pulling. This reduces the ratio of good products and increases manufacturing cost.

SUMMARY OF THE INVENTION

It is therefore a primary object of the present invention to provide a lighting connector including a terminal enclosure and an adapter circuit board. Multiple terminals are enclosed in the terminal enclosure. Rear ends of the terminals protrude from a rear end of the terminal enclosure and are defined as soldered sections. A first side of the adapter circuit board is provided with multiple terminal contacts with which the soldered sections of the terminals are respectively soldered. A second side of the adapter circuit board is provided with multiple wire contacts with which bare wires of front sections of signal wires are respectively soldered. The lighting connector of the present invention further includes an insulating layer enclosing the terminal enclosure, the adapter circuit board and the front sections of the signal wires. The insulating layer is made of a transparent material. At least one light-emitting element is soldered on the adapter circuit board. Two electrode pins of the light-emitting element are respectively connected to a set of printed power circuits of the adapter circuit board. After turned on, the light-emitting element emits light which goes through the transparent insulating layer to outer side.

The present invention can be best understood through the following description and accompanying drawings wherein:

DETAILED DESCRIPTION OF THE PREFERRED EMBODIMENTS

Figure 1:
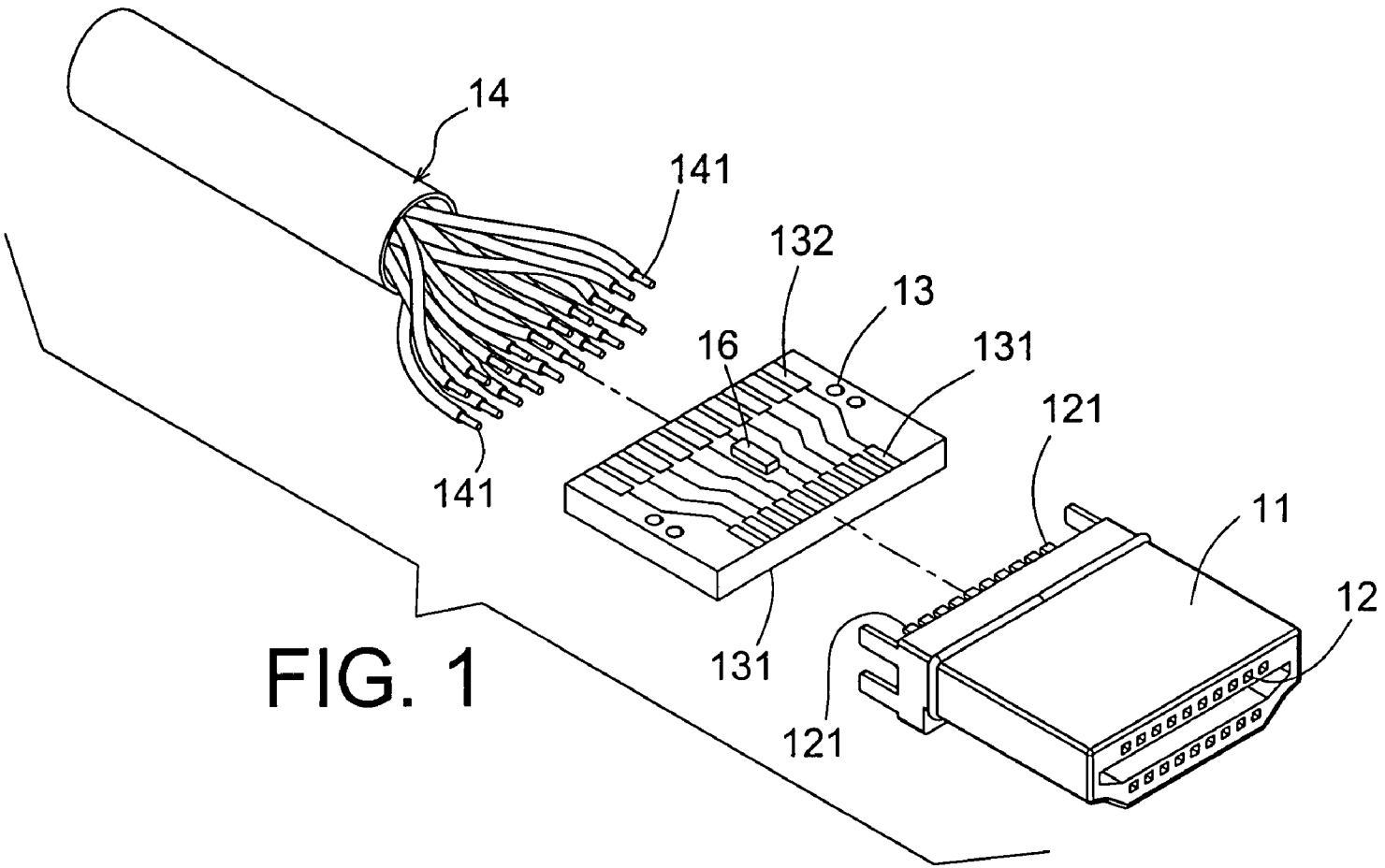
FIG. 1 is a perspective partially exploded view of the lighting connector of the present invention.
Figure 2:
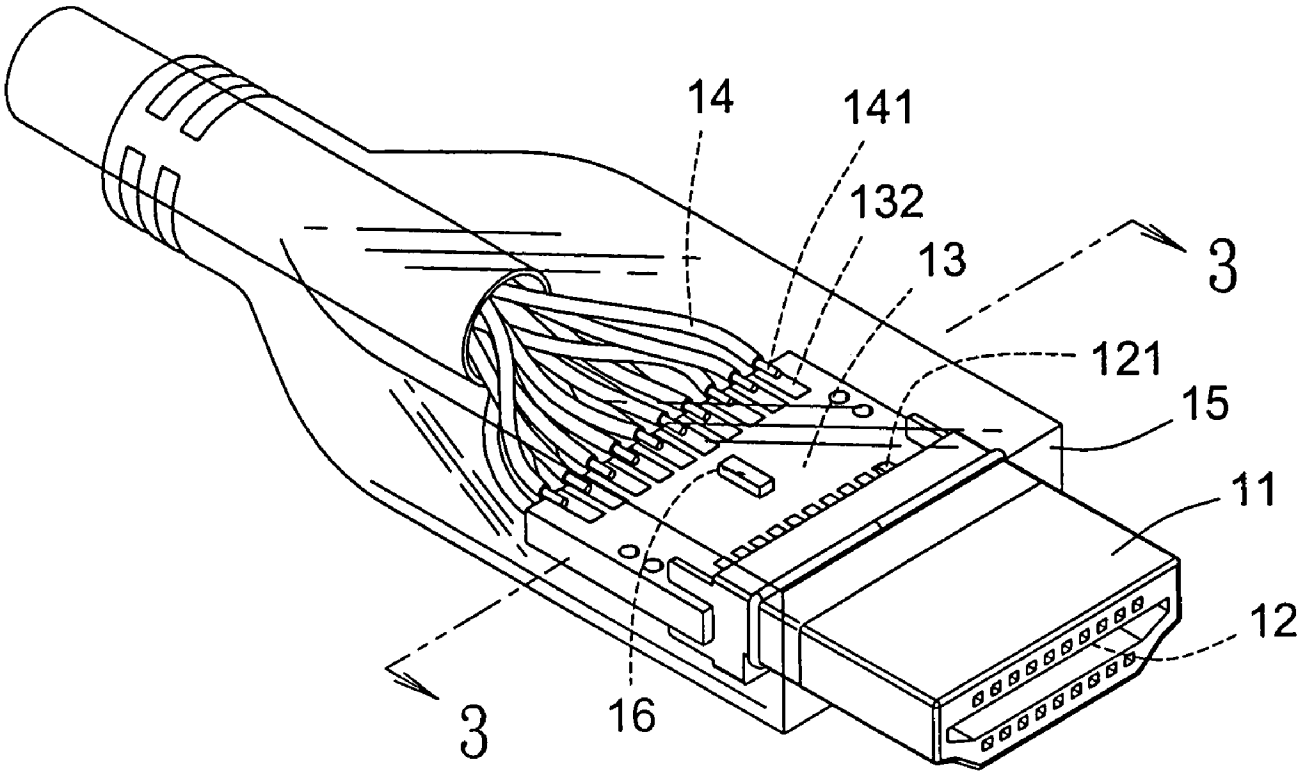
FIG. 2 is a perspective exploded view of the lighting connector of the present invention.
Figure 3:
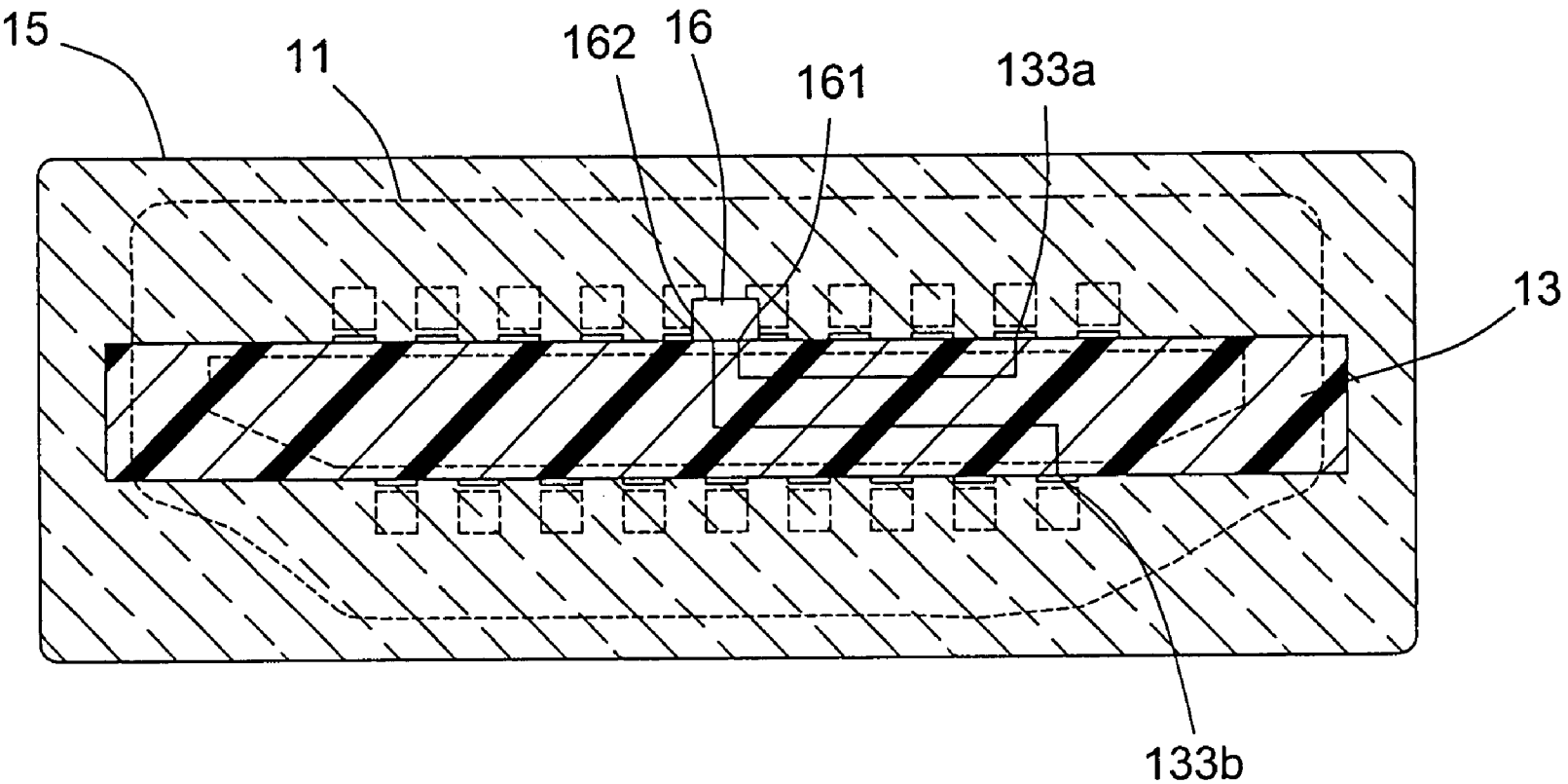
FIG. 3 is a sectional view taken along line 3-3 of FIG. 2.

Please refer to FIGS. 1, 2 and 3. The lighting connector of the present invention includes a terminal enclosure 11 and an adapter circuit board 13. Multiple terminals 12 are enclosed in the terminal enclosure 11. Rear ends of the terminals 12 protrude from a rear end of the terminal enclosure 11 and are defined as soldered sections 121. A first side of the adapter circuit board 13 is provided with multiple terminal contacts 131 with which the soldered sections 121 of the terminals 12 are respectively soldered. A second side of the adapter circuit board 13 is provided with multiple wire contacts 132 with which bare wires 141 of front sections of signal wires 14 are respectively soldered. The lighting connector of the present invention further includes an insulating layer 15 enclosing the terminal enclosure 11, the adapter circuit board 13 and the front sections of the signal wires 14. The insulating layer 15 is made of a transparent material. At least one light-emitting element 16 is soldered on the adapter circuit board 13. Two electrode pins 161, 162 of the light-emitting element 16 are respectively connected to a set of printed power circuits 133*a*, 133*b* of the adapter circuit board 13. After turned on, the light-emitting element 16 emits light which goes through the transparent insulating layer 15 to outer side.

The lighting connector of the present invention can be a high definition multimedia interface (HDMI) connector, a universal serial bus (USB) connector, etc. This is not limited.

The light-emitting element 16 of the present invention can be a light-emitting diode (LED), a color-changeable LED, etc. This is not limited.

The light-emitting element 16 is arranged on one face of the adapter circuit board 13. Alternatively, at least two light-emitting elements 16 are respectively arranged on two opposite faces of the adapter circuit board 13. The number of the light-emitting elements 16 arranged on the adapter circuit board 13 is not limited.

In conclusion, the lighting connector of the present invention is characterized in that the light-emitting element 16 is arranged on the adapter circuit board 13 connected between the terminals 12 and the signal wires 14. The two electrode pins 161, 162 of the light-emitting element 16 are directly connected to the set of printed power circuits 133*a*, 133*b* of the adapter circuit board 13. It is unnecessary to additionally connect a light-emitting element with the power wires so that the manufacturing procedure is simplified. After turned on, the light-emitting element 16 emits light which goes through the transparent insulating layer 15 to outer side. Accordingly, a user can judge whether the connector is in use or not. Also, the light-emitting element 16 is able to emit light for decorating the connector.

The above embodiments are only used to illustrate the present invention, not intended to limit the scope thereof. Many modifications of the above embodiments can be made without departing from the spirit of the present invention.

What is claimed is:

1. A lighting connector comprising:

a terminal enclosure in which multiple terminals are enclosed, rear ends of the terminals protruding from a rear end of the terminal enclosure and being defined as soldered sections;

an adapter circuit board, a first end portion of the adapter circuit board being provided with multiple terminal contacts to which the soldered sections of the terminals are respectively soldered, a second opposing end portion of the adapter circuit board being provided with multiple wire contacts to which bare wires of front sections of signal wires are respectively soldered;

at least one light emitting element soldered on the adapter circuit board, two electrode pins of the light-emitting element being respectively connected to a pair of printed power circuits of the adapter circuit board for illumination thereof responsive to the pair of printed power circuits being energized; and an imperforate insulating layer completely enclosing said soldered sections of the terminals and a portion of the terminal enclosure, the adapter circuit board and front sections of the signal wires, the insulating layer being formed of a transparent material, whereby light emitted from the light-emitting element passes through the transparent insulating layer to be visible external thereto.

2. The lighting connector as claimed in claim 1, wherein two light-emitting elements are respectively arranged on two opposite faces of the adapter circuit board, the light emitted from each of the light-emitting element passing through the transparent insulating layer.

* * * * *